US006245163B1

(12) United States Patent
Yonezawa et al.

(10) Patent No.: US 6,245,163 B1
(45) Date of Patent: Jun. 12, 2001

(54) AUSTENITIC STAINLESS STEEL RESISTANT TO NEUTRON-IRRADIATION-INDUCED DETERIORATION AND METHOD OF MAKING THEREOF

(75) Inventors: Toshio Yonezawa; Toshihiko Iwamura; Koji Fujimoto, all of Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/294,738

(22) Filed: Apr. 19, 1999

Related U.S. Application Data

(63) Continuation-in-part of application No. PCT/JP98/03584, filed on Aug. 12, 1998.

(51) Int. Cl.[7] ..... C21D 8/00; C22C 38/18

(52) U.S. Cl. ..... 148/326; 148/327; 148/607; 148/608

(58) Field of Search ..... 148/326, 327, 148/607, 610, 608

(56) References Cited

U.S. PATENT DOCUMENTS 5,976,275 * 11/1999 Yonezawa et al. ..... 148/326
5,987,088 * 11/1999 Aono et al. ..... 148/326

FOREIGN PATENT DOCUMENTS 52-52116 4/1977 (JP) .
093001319 * 1/1993 (WO) ..... 148/326

* cited by examiner

*Primary Examiner*—Deborah Yee
(74) *Attorney, Agent, or Firm*—Morgan & Finnegan, LLP

(57) ABSTRACT

An austenitic stainless steel having resistance to neutron-irradiation-induced deterioration obtained by subjecting a stainless steel consisting of not more than 0.08% by weight of C, not more than 2.0% by weight of Mn, not more than 1.5% by weight of Si, not more than 0.045% by weight of P, not more than 0.030% by weight of S, 8.0 to 22.0% of by weight Ni, 16.0 to 26.0% of by weight Cr and the balance as Fe; to thermal solid solution treatment at a temperature of 1,000° C. to 1,180° C. and then subjecting the so-treated steel to aging treatment at a temperature in the range of 600° C. to 750° C.

10 Claims, 1 Drawing Sheet

AUSTENITIC STAINLESS STEEL RESISTANT TO NEUTRON-IRRADIATION-INDUCED DETERIORATION AND METHOD OF MAKING THEREOF

This application is a continuation in part of Ser. No. PCT/JP98/03584 filed Aug. 12, 1998.

BACKGROUND OF THE INVENTION

1. Field of the Invention

The present invention relates to a thermal treated austenitic stainless steel having excellent resistance to neutron-irradiation-induced deterioration. The thermal treated austenitic steel is used, for example, as a structural member inside a light water reactor type nuclear power plant.

2. Description of the Related Art

Austenitic stainless steels, such as SUS 304 and SUS 316, which have conventionally been used for a structural member (bolt, plate and the like) inside a light water reactor type nuclear power plant, tend to lack Cr or have concentrated Ni, Si, P, S and the like in its grain boundary after long years of use and subjected to neutron irradiation of $1\times10^{21}$ n/cm$^2$ (E>1 MeV) or greater. Under the stress of a high load, the austenitic stainless steel tends to exhibit stress corrosion cracking (SCC) under use in a light water reactor. Such a phenomenon is called "irradiation-affected stress corrosion cracking" (IASCC). Although there is a strong demand for the development of a material having low IASCC sensitivity, or in other words, having excellent resistance to neutron-irradiation-induced deterioration, no such material has yet been developed.

Austenitic stainless steels such as SUS 304 and SUS 316 have been used as structural material inside a light water atomic power reactor. When such materials have been in use for long periods of time and subjected to neutron irradiation of $1\times10^{21}$ n/cm$^2$ (E>1 MeV) or greater, an undesirable change is observed in the concentration of certain elements in the vicinity of the grain boundary which was not present or was present only to a slight extent prior to use. In other words, a lack of Cr and Mo or enrichment of elements such as Ni, Si, P and S in the vicinity of the grain boundary is observed. This phenomenon is called "irradiation-induced segregation". It is known that in this segregated state, the presence of a high load stress or residual stress tends to cause stress corrosion cracking (irradiation affected stress corrosion cracking: IASCC) in water of high temperature and high pressure, the neutron irradiated environment of a light water reactor.

The present inventors had developed and previously proposed a Ni-rich austenitic stainless steel as a material having excellent resistance to neutron-irradiation-induced deterioration. The Ni-rich stainless steel of a specific composition was treated thermally to optimize the crystalline form of the alloy and then subjecting the resultant steel to post processing. (Japanese Patent Application Laid-Open No. 9-125205).

SUMMARY OF THE INVENTION

An object of the present invention is to provide a structural material which has been used conventionally, such as SUS 304, SUS 316 or SUS 310S specified in JIS (Japanese Industrial Standards) as a base alloy that is resistant to neutron-irradiation-induced deterioration, without having to use a stainless steel having a high Ni content, and yet does not exhibit stress corrosion cracking (SCC) in water of high temperature and high pressure, the environment of a light water reactor.

The present inventors have conducted various investigations on the properties of austenitic stainless steel. Employing the method of measuring the value of the intergranular segregation of a neutron irradiated material as described by S. Dumbill and W. Hanks (Sixth International Symposium on Environmental Degradation of Materials in Nuclear Power Systems-Water Reactors, 521(1993)), the concentration changes of Cr and Ni in the grain boundary were calculated by the present inventors. The concentration changes were compared with the test results of SCC of neutron-irradiated SUS 304 and SUS 316 collected by the present inventors and shown in FIG. 1. The data shows that IASCC occurs when the concentration of Cr is reduced to less than 15% and that of Ni increased to more than 20% in the grain boundary after neutron irradiation. The cross hatched portion of FIG. 1 illustrates the region of SCC generation.

The present inventors hypothesized that the phenomenon of IASCC occurs because the concentration of elements in the grain boundary approaches to that of the composition of Alloy 600 (NCF600 of JIS). Specifically, neutron irradiation reduces the Cr concentration and increases the Ni concentration in the grain boundary making the composition therein proximate that of Alloy 600 (non-irradiated material; Ni≧72%, Cr=14~17%). It had been frequently observed that with Alloy 600, stress corrosion cracking (PWSCC: stress corrosion cracking which occurs in a primary water) occurs in water of high temperature and high pressure. However, up to the present, the mechanism of PWSCC has not been elucidated in detail.

It has been known that in conventional Ni-based alloys, Incone 1750 (NCF750 of JIS) or Alloy 690 (NCF690 of JIS), the grain boundaries are strengthened with improved PWSCC resistance by subjecting it to special thermal aging treatment under specific conditions. The treatment caused precipitation, in the grain boundary, of $M_{23}C_6$ (a carbide having mainly Cr as M) to matching that of the matrix phase. The present inventors have found that when the special thermal treatment employed for a Ni-based alloy is applied to the conventional SUS 304, SUS 316 or SUS 310S, the grain boundary can be reinforced and SCC resistance improved by precipitating $M_{23}C_6$ matching that of the matrix phase in the grain boundary, even if neutron irradiation lowers the Cr concentration and raises the Ni concentration of the composition in the vicinity of the grain boundary.

Based on these findings, the present inventors proceeded to further investigate and develop the present invention, wherein SUS 304 or SUS 316 was employed as a base alloy and applying a combination of solid solution treatment under specific conditions, aging thermal treatment to optimize the crystalline form in the alloy and post-processing (cold working) treatment.

The present invention provides an austenitic stainless steel having resistance to neutron-irradiation-induced deterioration obtained by subjecting a stainless steel consisting of not more than 0.08% by weight of C, not more than 2.0% by weight of Mn, not more than 1.5% by weight of Si, not more than 0.045% by weight of P, not more than 0.030% by weight of S, 8.0 to 22.0% of by weight Ni, 16.0 to 26.0% of by weight Cr and the balance of Fe, to thermal solid solution treatment at 1,000° to 1,180° C. and then to aging treatment at 600° to 750° C.

Optionally, the austenitic stainless steel according to the present invention can be obtained by further subjecting said stainless steel to cold working treatment up to 30% of the cross-sectional area of the material subjected to thermal solid solution treatment and aging treatment.

The stainless steel used in the present invention may contain 3.0% by weight or less of Mo. For example, the stainless steel may be SUS 316 specified in JIS. When SUS 316 is used, the temperature range of said thermal solid solution treatment is 1,000° C. to 1,150° C.

Further, the stainless steel may be SUS 304 specified in JIS. When SUS 304 is used, the temperature range of said thermal solid solution treatment is 1,000° C. to 1,150° C.

Furthermore, the stainless steel may be SUS 310S specified in JIS. When SUS 310S is used, the temperature range of said thermal solid solution treatment is 1,030° C. to 1,180° C.

DETAILED DESCRIPTION OF THE PREFERRED EMBODIMENTS

Figure 1:
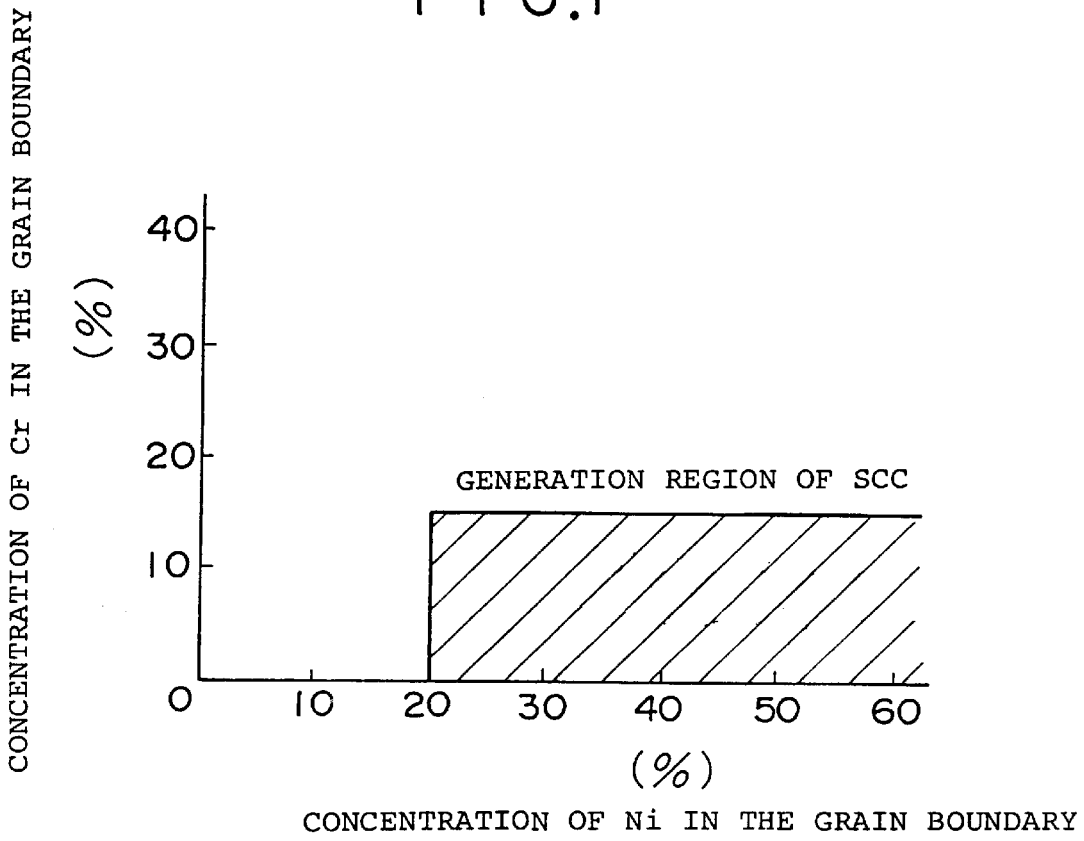
FIG. 1 illustrates the relationship between Cr and Ni concentrations in the grain boundary and SCC sensitivity of an alloy based on the measured value of intergranular segregation of a neutron-irradiated material.

The austenitic stainless steel of the present invention is resistant to neutron-irradiation-induced deterioration and has excellent SCC resistance under the environment of a light water reactor. More specifically, the material is resistant to neutron-irradiation-induced deterioration and has excellent SCC resistance in water at a high temperature of about 270° C. to 360° C. and a high pressure of about 70 to 160 atm, even after exposed to neutron irradiation of at least $1\times10^{22}$ n/cm$^2$ (E>1 MeV). Since the structural material used inside of a reactor is mainly austenitic stainless steel such as SUS 304 or SUS 316, it is necessary to use a material having a similar thermal expansion coefficient to that of SUS 304 or SUS 316 to reduce stress that may be imparted by a difference in thermal expansion coefficients between different structural materials. The austenitic stainless steel according to the present invention maintains a thermal expansion coefficient of $15\times10^{-6}$ to $19\times10^{-6}$/K, which is close to $16\times10^{-6}$ to $18\times10^{-6}$/K, the average thermal expansion coefficient of conventionally used SUS 304 or SUS 316 in the temperature range from a room temperature of 20° C. to 400° C.

Examples of the austenitic stainless steel having such properties include austenitic stainless steels obtained by using as a base material:

SUS 304 specified in JIS, the composition in weight % of which is not more than 0.08% of C, not more than 2.0% of Mn, not more than 1.0% of Si, not more than 0.045% of P, not more than 0.030% of S, 8.0 to 10.5% of Ni, 18.00 to 20.00% of Cr with the balance as Fe; SUS 316 specified in JIS and the composition in weight % of which is not more than 0.08% of C, not more than 2.0% of Mn, not more than 1.0% of Si, not more than 0.045% of P, not more than 0.030% of S, 10.0 to 14.0% of Ni, 16.00 to 18.00% of Cr, 2.00 to 3.00% of Mo with the balance as Fe; or SUS 310S specified in JIS and the composition in weight % of which is not more than 0.08% of C, not more than 2.00% of Mn, not more than 1.50% of Si, not more than 0.045% of P, not more than 0.030% of S, 19.0 to 22.0% of Ni, 24.00 to 26.00% of Cr with the balance as Fe;

The base steel is subjected to thermal solid solution treatment at 1,000° C. to 1,150° C. for SUS 304 or SUS 316 or 1,030 to 1,180° C. for SUS 310S;

Optionally, the base steel is subjected to cold working treatment up to 30% of the cross-sectional area at a temperature range not higher than the recrystallization point after thermal solid solution treatment; and Subjecting the steel to aging treatment at 600° C. to 750° C. for up to 100 hours.

Using the process of the present invention, precipitation of $M_{23}C_6$ (a carbide having mainly Cr as M) matching that of the matrix phase appears in the grain boundary, and an austenitic steel having a strengthened grain boundary and improved SCC resistance is provided.

When SUS 304 or SUS 316 having the above-described composition is subjected to solid solution treatment at 1,000° C. to 1,150° C. or when SUS 310S having the above-described composition is subjected to solid solution treatment at 1,030° C. to 1,180° C., the atoms in the alloy form a solid solution matrix. The austenitic stainless steel so treated is, if desired, subjected to cold working treatment of a maximum of 30% in cross-sectional area within a temperature range not higher than its recrystallization point to prevent in the crystal grains a dislocation due to sliding deformation, to improve its strength as a bolt material or the like without losing its SCC resistance. The heating treatment or aging treatment at 600° C. to 750° C. subsequent to the above-described solid solution treatment or both the solid solution treatment and cold working treatment permits the precipitation of $M_{23}C_6$ (a carbide having mainly Cr as M) matching that of the matrix phase in the grain boundary, to strengthen the grain boundary and improves SCC resistance. The cold working treatment is optional and is done to assure the strength of products to which the present invention is applied.

To attain the object of the present invention, the degree of cold working treatment is not required to be large and a maximum of 30% or so of the cross sectional area is sufficient. When the degree of cold working exceeds 30%, the stainless steel so obtained is not suitable as a structural material because there is a reduction in ductility despite an increase in SCC strength.

When the aging treatment is effected at a temperature lower than 600° C., it is not sufficient to precipitate $M_{23}C_6$ to match that of the matrix phase in the grain boundary even with heating for an extended period and the target SCC resistance is not obtained. On the other hand, when the aging temperature exceeds 750° C., a solid solution reforms and precipitation of $M_{23}C_6$ to match that of the matrix phase does not occur. Accordingly, a preferred temperature range for the aging treatment to cause sufficient precipitation of $M_{23}C_6$ is from 600° C. to 750° C. Although a short aging treatment is effective within a temperature range of 600° C. to 750° C., it is preferable to carry out the treatment for at least one hour to sufficiently precipitate $M_{23}C_6$ and attain a high SCC resistance. In general, up to 100 hours, preferably 10–50 hours, or more preferably 30–50 hours is sufficient for the treatment. In addition, if necessary, cold working treatment up to 30% is done to assure the strength of products to which the present invention is applied.

It is likely that irradiation-affected stress corrosion cracking (IASCC) attributable to high load stress and neutron irradiation occurs almost simultaneously with the deterioration of the material. It is the goal of the present invention to control in advance the composition of the material and its metallographic structure so as to suppress the deterioration to an extent thereby IASCC does not easily occur even when the material is exposed to neutron irradiation. In other words, the present invention provides a process whereby SUS 304, SUS 316 or SUS 310S is used as a base alloy minimizing the difference in the thermal expansion coefficient of the conventional material even after the heat treatment; and that by precipitating a carbide in the grain boundary, IASCC does not easily occur.

EXAMPLES

Four groups of test materials to be tested were prepared as follows. Two of the groups were obtained by subjecting SUS 304 and SUS 316 having chemical compositions, respectively shown in Table 1, to solid solution treatment at 1,050° C. for an hour, followed by aging thermal treatment for 100 hours at temperatures shown in Tables 2 to 9.

Another two groups were obtained by subjecting the solid solution treated steel to cold working treatment in a range 10 to 30%, followed by aging thermal treatment for 100 hours at temperatures as shown in Tables 2 to 9.

Figure 2:
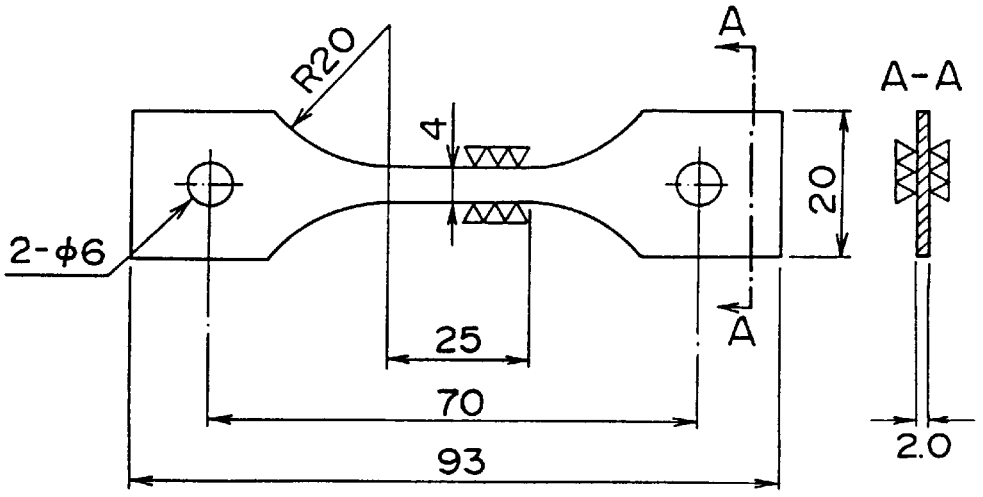
FIG. 2 illustrates the shape and size of the test piece used in the SCC acceleration test.

Those four groups of test materials so obtained were processed into test pieces having the shape and size as shown in FIG. 2, wherein the unit is mm, followed by neutron irradiation of at least $5\times10^{22}$ n/cm$^2$ (E>1 Mev) and tested at 320° C. in an atomic reactor. Then, a stress corrosion cracking acceleration test was conducted at a strain rate of 0.1 $\mu$m/min under the simulated environment of a light water reactor, at a high temperature of 360° C. and a high pressure of 160 kgf/cm$^2$G in water. Incidentally, these materials do not show SCC sensitivity without irradiation so that irradiated material was provided for the evaluation.

TABLE 1

| | Chemical component (wt. %), balance: Fe | | | | | | | |
|---|---|---|---|---|---|---|---|---|
| | C | Si | Mn | P | S | Ni | Cr | Mo |
| SUS 304 | 0.06 | 0.55 | 1.52 | 0.02 | 0.021 | 8 | 18 | — |
| SUS 316 | 0.04 | 0.75 | 1.65 | 0.018 | 0.011 | 12 | 16 | 26 |
| SUS 310S | 0.02 | 0.32 | 1.14 | 0.024 | 0.001 | 19.58 | 24.31 | — |

As shown in Tables 2 to 9 the results show an average thermal expansion coefficient, from room temperature to 400° C., for the test piece in the range of from $15.7\times10^{-6}$ to $16.8\times10^{-6}$/K for SUS 304 series and from $16.2\times10^{-6}$ to $17.7\times10^{-6}$/K for SUS 316 series. In Tables 2–9, the term "precipitation of carbide $M_{23}C_6$" of Table 2, describes a semi-continuous precipitation of $M_{23}C_6$ in the grain boundary as observed through a transmission electron microscope (TEM) and an electron microscope (SEM). When no precipitation is found, or coarse growth of grains wherein the precipitation is not semi-continuous are found, the precipitation of a carbide is "not observed". "IGSCC" means intergranular stress corrosion cracking and "IGSCC fracture ratio" means a value represented by:

$$\frac{\sum \text{area of fractured region in the grain boundary}}{\sum \text{total area of fractured region of a test piece}} \times 100\,(\%)$$

"SCC sensitivity" is evaluated based on the intergranular fracture ratio (IGSCC fracture ratio) of a broken surface after the stress corrosion cracking acceleration test. When an IGSCC fracture ratio exceeds 5%, the material is judged "sensitive" (A). When it is not higher than 5%, on the other hand, the material is judged "not sensitive" (B). In addition, "SSRT" means a low strain rate tensile test.

Based on the results reported in Tables 2 to 9, it can be surmised that the tested material should have an intergranular fracture ratio (IGSCC fracture ratio) which is presumed to have the greatest influence on IASCC resistance close to 0, preferably not higher than 5%. Further, the material in which precipitated $M_{23}C_6$ matched with the matrix phase in the grain boundary is obtained by aging treatment within a temperature range of 600° C. to 750° C. and a duration of 5 to 100 hours. The results have been confirmed using a transmission electron microscope (TEM) and an electron microscope (SEM) that in those test materials, a semi-continuous precipitation of $M_{23}C_6$ is shown. It can be observed that the test materials have excellent SCC resistance irrespective of the cold working treatment.

TABLE 2

| Materials to be tested | Cold working treatment ratio (%) | Aging treatment conditions Temp. (° C.) | Time (h) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 304 | 0 | No thermal treatment | — | Not observed | 75 | A | 16.2 |
| | | 500 | 1 | Not observed | 71 | A | 16.5 |
| | | | 5 | Not observed | 65 | A | 16.3 |
| | | | 10 | Not observed | 53 | A | 16.1 |
| | | | 50 | Not observed | 39 | A | 16.0 |
| | | | 100 | Not observed | 30 | A | 16.5 |
| | | 600 | 1 | Not observed | 15 | A | 16.2 |
| | | | 5 | Observed | 0 | B | 16.2 |
| | | | 10 | Observed | 0 | B | 16.5 |
| | | | 50 | Observed | 0 | B | 16.2 |
| | | | 100 | Observed | 0 | B | 16.3 |
| | | 700 | 1 | Observed | 3 | B | 16.4 |
| | | | 5 | Observed | 0 | B | 16.5 |
| | | | 10 | Observed | 0 | B | 16.2 |
| | | | 50 | Observed | 0 | B | 16.1 |
| | | | 100 | Observed | 0 | B | 16.2 |
| | | 750 | 1 | Observed | 1 | B | 15.9 |
| | | | 5 | Observed | 0 | B | 16.4 |
| | | | 10 | Observed | 0 | B | 16.2 |
| | | | 50 | Observed | 0 | B | 16.5 |
| | | | 100 | Observed | 0 | B | 16.2 |
| | | 800 | 1 | Not observed | 8 | A | 16.7 |
| | | | 5 | Not observed | 17 | A | 15.8 |

TABLE 2-continued

| Materials to be tested | Cold working treatment ratio (%) | Aging treatment conditions Temp. (° C.) | Time (h) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| | | | 10 | Not observed | 15 | A | 16.0 |
| | | | 50 | Not observed | 20 | A | 16.3 |
| | | | 100 | Not observed | 14 | A | 16.1 |

SCC sensitivity (A: sensitive, B: not sensitive)

TABLE 3

| Materials to be tested | Cold working treatment ratio (%) | Aging treatment conditions Temp. (° C.) | Time (h) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 304 | 10 | No thermal treatment | — | Not observed | 65 | A | 15.8 |
| | | 500 | 1 | Not observed | 55 | A | 16.1 |
| | | | 5 | Not observed | 50 | A | 16.2 |
| | | | 10 | Not observed | 58 | A | 16.5 |
| | | | 50 | Not observed | 43 | A | 16.7 |
| | | | 100 | Not observed | 28 | A | 16.0 |
| | | 600 | 1 | Observed | 2 | B | 16.3 |
| | | | 5 | Observed | 0 | B | 16.4 |
| | | | 10 | Observed | 0 | B | 16.2 |
| | | | 50 | Observed | 0 | B | 16.1 |
| | | | 100 | Observed | 0 | B | 16.8 |
| | | 700 | 1 | Observed | 1 | B | 16.2 |
| | | | 5 | Observed | 0 | B | 16.1 |
| | | | 10 | Observed | 0 | B | 15.8 |
| | | | 50 | Observed | 0 | B | 15.9 |
| | | | 100 | Observed | 0 | B | 16.3 |
| | | 750 | 1 | Observed | 0 | B | 16.1 |
| | | | 5 | Observed | 0 | B | 16.2 |
| | | | 10 | Observed | 0 | B | 16.3 |
| | | | 50 | Observed | 0 | B | 16.8 |
| | | | 100 | Observed | 0 | B | 16.5 |
| | | 800 | 1 | Not observed | 10 | A | 16.6 |
| | | | 5 | Not observed | 5 | A | 15.8 |
| | | | 10 | Not observed | 8 | A | 16.1 |
| | | | 50 | Not observed | 15 | A | 16.5 |
| | | | 100 | Not observed | 19 | A | 16.3 |

SCC sensitivity (A: sensitive, B: not sensitive)

TABLE 4

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 304 | 20 | No thermal treatment | — | Not observed | 52 | A | 16.3 |
| | | 500 | 1 | Not observed | 50 | A | 16.2 |
| | | | 5 | Not observed | 60 | A | 16.2 |
| | | | 10 | Not observed | 45 | A | 16.2 |
| | | | 50 | Not observed | 16 | A | 16.5 |
| | | | 100 | Not observed | 4 | B | 16.8 |
| | | 600 | 1 | Observed | 3 | B | 16.3 |
| | | | 5 | Observed | 1 | B | 16.7 |
| | | | 10 | Observed | 0 | B | 16.4 |
| | | | 50 | Observed | 0 | B | 15.8 |
| | | | 100 | Observed | 0 | B | 15.9 |
| | | 700 | 1 | Observed | 0 | B | 16.5 |
| | | | 5 | Observed | 0 | B | 16.3 |
| | | | 10 | Observed | 0 | B | 16.4 |
| | | | 50 | Observed | 0 | B | 16.3 |
| | | | 100 | Observed | 0 | B | 16.2 |
| | | 750 | 1 | Observed | 0 | B | 16.1 |
| | | | 5 | Observed | 0 | B | 16.6 |
| | | | 10 | Observed | 0 | B | 16.2 |
| | | | 50 | Observed | 0 | B | 16.6 |

TABLE 4-continued

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| | | | 100 | Observed | 0 | B | 16.2 |
| | | 800 | 1 | Not observed | 18 | A | 16.8 |
| | | | 5 | Not observed | 20 | A | 15.7 |
| | | | 10 | Not observed | 17 | A | 16.5 |
| | | | 50 | Not observed | 13 | A | 16.3 |
| | | | 100 | Not observed | 6 | A | 16.3 |

SCC sensitivity (A: sensitive, B: not sensitive)

TABLE 5

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 304 | 30 | No thermal treatment | — | Not observed | 55 | A | 16.3 |
| | | 500 | 1 | Not observed | 55 | A | 16.2 |
| | | | 5 | Not observed | 60 | A | 16.2 |
| | | | 10 | Not observed | 20 | A | 16.2 |
| | | | 50 | Observed | 4 | B | 16.5 |
| | | | 100 | Observed | 2 | B | 16.7 |
| | | 600 | 1 | Observed | 1 | B | 16.3 |
| | | | 5 | Observed | 0 | B | 16.5 |
| | | | 10 | Observed | 0 | B | 16.4 |
| | | | 50 | Observed | 0 | B | 15.9 |
| | | | 100 | Observed | 0 | B | 16.3 |
| | | 700 | 1 | Observed | 0 | B | 16.5 |
| | | | 5 | Observed | 0 | B | 16.3 |
| | | | 10 | Observed | 0 | B | 16.7 |
| | | | 50 | Observed | 0 | B | 16.3 |
| | | | 100 | Observed | 0 | B | 16.2 |
| | | 750 | 1 | Observed | 0 | B | 16.3 |
| | | | 5 | Observed | 0 | B | 16.7 |
| | | | 10 | Observed | 0 | B | 16.8 |
| | | | 50 | Observed | 0 | B | 16.6 |
| | | | 100 | Observed | 0 | B | 16.5 |
| | | 800 | 1 | Not observed | 13 | A | 16.4 |
| | | | 5 | Not observed | 15 | A | 15.8 |
| | | | 10 | Not observed | 20 | A | 16.3 |
| | | | 50 | Not observed | 15 | A | 16.5 |
| | | | 100 | Not observed | 8 | A | 16.7 |

SCC sensitivity (A: sensitive, B: not sensitive)

TABLE 6

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 316 | 0 | No thermal treatment | — | Not observed | 65 | A | 17.2 |
| | | 500 | 1 | Not observed | 63 | A | 17.2 |
| | | | 5 | Not observed | 57 | A | 17.1 |
| | | | 10 | Not observed | 70 | A | 17.2 |
| | | | 50 | Not observed | 36 | A | 17.4 |
| | | | 100 | Not observed | 23 | A | 16.9 |
| | | 600 | 1 | Not observed | 12 | A | 16.8 |
| | | | 5 | Observed | 0 | B | 17.3 |
| | | | 10 | Observed | 0 | B | 17.5 |
| | | | 50 | Observed | 0 | B | 17.4 |
| | | | 100 | Observed | 0 | B | 17.3 |
| | | 700 | 1 | Observed | 3 | B | 17.1 |
| | | | 5 | Observed | 0 | B | 17.0 |
| | | | 10 | Observed | 0 | B | 17.2 |
| | | | 50 | Observed | 0 | B | 16.8 |
| | | | 100 | Observed | 0 | B | 16.5 |
| | | 750 | 1 | Observed | 2 | B | 16.4 |

TABLE 6-continued

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| | | | 5 | Observed | 0 | B | 16.8 |
| | | | 10 | Observed | 0 | B | 16.5 |
| | | | 50 | Observed | 0 | B | 16.4 |
| | | | 100 | Observed | 0 | B | 16.3 |
| | | 800 | 1 | Not observed | 15 | A | 16.4 |
| | | | 5 | Not observed | 18 | A | 16.2 |
| | | | 10 | Not observed | 23 | A | 16.3 |
| | | | 50 | Not observed | 21 | A | 16.5 |
| | | | 100 | Not observed | 15 | A | 16.8 |

SCC sensitivity (A: sensitive, B: not sensitive)

TABLE 7

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 316 | 10 | No thermal treatment | — | Not observed | 70 | A | 17.3 |
| | | 500 | 1 | Not observed | 55 | A | 17.5 |
| | | | 5 | Not observed | 52 | A | 17.2 |
| | | | 10 | Not observed | 46 | A | 16.9 |
| | | | 50 | Not observed | 31 | A | 17.3 |
| | | | 100 | Not observed | 8 | A | 17.3 |
| | | 600 | 1 | Observed | 1 | B | 17.3 |
| | | | 5 | Observed | 0 | B | 17.2 |
| | | | 10 | Observed | 0 | B | 17.4 |
| | | | 50 | Observed | 0 | B | 17.1 |
| | | | 100 | Observed | 0 | B | 17.0 |
| | | 700 | 1 | Observed | 1 | B | 17.3 |
| | | | 5 | Observed | 0 | B | 17.6 |
| | | | 10 | Observed | 0 | B | 17.4 |
| | | | 50 | Observed | 0 | B | 16.3 |
| | | | 100 | Observed | 0 | B | 16.5 |
| | | 750 | 1 | Observed | 0 | B | 16.8 |
| | | | 5 | Observed | 0 | B | 16.7 |
| | | | 10 | Observed | 0 | B | 16.6 |
| | | | 50 | Observed | 0 | B | 16.5 |
| | | | 100 | Observed | 0 | B | 16.4 |
| | | 800 | 1 | Not observed | 20 | A | 16.8 |
| | | | 5 | Not observed | 17 | A | 16.2 |
| | | | 10 | Not observed | 22 | A | 16.5 |
| | | | 50 | Not observed | 13 | A | 16.5 |
| | | | 100 | Not observed | 17 | A | 16.3 |

SCC sensitivity (A: sensitive, B: not sensitive)

TABLE 8

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 316 | 20 | No thermal treatment | — | Not observed | 55 | A | 17.3 |
| | | 500 | 1 | Not observed | 55 | A | 17.6 |
| | | | 5 | Not observed | 60 | A | 17.4 |
| | | | 10 | Not observed | 45 | A | 16.8 |
| | | | 50 | Not observed | 20 | A | 16.5 |
| | | | 100 | Observed | 4 | B | 16.8 |
| | | 600 | 1 | Observed | 3 | B | 17.4 |
| | | | 5 | Observed | 1 | B | 17.3 |
| | | | 10 | Observed | 0 | B | 17.5 |
| | | | 50 | Observed | 0 | B | 17.2 |
| | | | 100 | Observed | 0 | B | 15.9 |
| | | 700 | 1 | Observed | 0 | B | 17.3 |
| | | | 5 | Observed | 0 | B | 17.5 |
| | | | 10 | Observed | 0 | B | 17.2 |

TABLE 8-continued

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| | | | 50 | Observed | 0 | B | 16.3 |
| | | | 100 | Observed | 0 | B | 17.3 |
| | | 750 | 1 | Observed | 0 | B | 17.6 |
| | | | 5 | Observed | 0 | B | 17.4 |
| | | | 10 | Observed | 0 | B | 16.3 |
| | | | 50 | Observed | 0 | B | 17.3 |
| | | | 100 | Observed | 0 | B | 17.6 |
| | | 800 | 1 | Not observed | 18 | A | 17.4 |
| | | | 5 | Not observed | 20 | A | 16.3 |
| | | | 10 | Not observed | 17 | A | 17.3 |
| | | | 50 | Not observed | 13 | A | 17.5 |
| | | | 100 | Not observed | 6 | A | 17.2 |

SCC sensitivity (A: sensitive, B: not sensitive)

TABLE 9

| Materials to be tested | Cold working treatment ratio (%) | Aging treatment conditions Temp. (° C.) | Temp. (° C.) | Precipitation of carbide $M_{23}C_6$ | IGSCC fracture ratio (%) | SCC sensitivity | Thermal expansion coefficient ($\times 10^{-6}$/K) |
|---|---|---|---|---|---|---|---|
| SUS 316 | 30 | No thermal treatment | — | Not observed | 75 | A | 17.5 |
| | | 500 | 1 | Not observed | 70 | A | 17.3 |
| | | | 5 | Not observed | 65 | A | 17.5 |
| | | | 10 | Not observed | 18 | A | 17.2 |
| | | | 50 | Not observed | 3 | B | 17.3 |
| | | | 100 | Not observed | 2 | B | 17.5 |
| | | 600 | 1 | Not observed | 2 | B | 16.8 |
| | | | 5 | Observed | 0 | B | 17.4 |
| | | | 10 | Observed | 0 | B | 17.3 |
| | | | 50 | Observed | 0 | B | 17.5 |
| | | | 100 | Observed | 0 | B | 17.2 |
| | | 700 | 1 | Observed | 0 | B | 17.4 |
| | | | 5 | Observed | 0 | B | 17.3 |
| | | | 10 | Observed | 0 | B | 17.5 |
| | | | 50 | Observed | 0 | B | 16.8 |
| | | | 100 | Observed | 0 | B | 17.7 |
| | | 750 | 1 | Observed | 0 | B | 16.8 |
| | | | 5 | Observed | 0 | B | 17.3 |
| | | | 10 | Observed | 0 | B | 16.9 |
| | | | 50 | Observed | 0 | B | 16.8 |
| | | | 100 | Observed | 0 | B | 17.3 |
| | | 800 | 1 | Not observed | 5 | A | 17.2 |
| | | | 5 | Not observed | 13 | A | 17.3 |
| | | | 10 | Not observed | 18 | A | 17.5 |
| | | | 50 | Not observed | 21 | A | 17.3 |
| | | | 100 | Not observed | 16 | A | 16.8 |

SCC sensitivity (A: sensitive, B: not sensitive)

Two further groups of test materials were prepared as follows. One group was obtained by subjecting SUS 310S having a chemical composition shown in Table 1, to solid solution treatment at 1,050° C. for an hour, followed by aging thermal treatment for 100 hours at temperatures shown in Table 10.

Another group of test materials was obtained by subjecting the stainless, subsequent to the solid solution treatment, to cold working treatment of about 20%, followed by aging thermal treatment for 100 hours at temperatures shown in Table 10.

Those two groups of the test materials were processed into test pieces having the shape and size as shown in FIG. 2, followed by neutron irradiation of at least $5\times10^{22}$ n/cm$^2$ (E>1 MeV) and tested at 320° C. in an atomic reactor. Then, a stress corrosion cracking acceleration test was conducted at a strain rate of 0.5 $\mu$m/min under the simulated environment of a light water reactor at a high temperature of 360° C. and a high pressure of 214 kgf/cm$^2$G in water. Test results are shown in Table 10.

TABLE 10

| Materials to be tested | Aging treatment conditions | Precipitation of carbide $M_{23}C_6$ | IGSCC fracture ratio (%) | SCC sensitivity |
|---|---|---|---|---|
| 310S stainless | No thermal treatment | Not observed | 46 | A |

TABLE 10-continued

| Materials to be tested | Aging treatment conditions | Precipitation of carbide $M_{23}C_6$ | IGSCC fracture ratio (%) | SCC sensitivity |
|---|---|---|---|---|
| steel | 500° C. × 100 h | Not observed | 39 | A |
| | 550° C. × 100 h | Not observed | 28 | A |
| | 600° C. × 100 h | Observed | 4 | B |
| | 650° C. × 100 h | Observed | 2 | B |
| | 700° C. × 100 h | Observed | 1 | B |
| | 750° C. × 100 h | Observed | 3 | B |
| | 800° C. × 100 h | Not observed | 19 | A |
| 310S stainless steel + coldworking treatment (20%) | No thermal treatment | Not observed | 43 | A |
| | 500° C. × 100 h | Not observed | 37 | A |
| | 550° C. × 100 h | Not observed | 24 | A |
| | 600° C. × 100 h | Observed | 3 | B |
| | 650° C. × 100 h | Observed | 1 | B |
| | 700° C. × 100 h | Observed | 0 | B |
| | 750° C. × 100 h | Observed | 1 | B |
| | 800° C. × 100 h | Not observed | 16 | A |

SCC sensitivity (A: sensitive, B: not sensitive)

In Table 10, the terms "precipitation of carbide $M_{23}C_6$", "IGSCC fracture ratio" and "SCC sensitivity" are the same as those in tables 2 to 9.

The following can be observed from Table 10. The tested material should have an intergranular fracture ratio (IGSCC fracture ratio) presumed to have the greatest influence on IASCC resistance close to 0, preferably not higher than 5%. Further, test materials in which precipitation of $M_{23}C_6$ matched with the matrix phase in the grain boundary is obtained by aging treatment of up to 100 hours and within a temperature range of 600° C. to 750° C. Sufficiency of $M_{23}C_6$ as shown by semi-continuous precipitation was confirmed by observation using a transmission electron microscope (TEM) and an electron microscope (SEM). It can be observed that the test materials have excellent SCC resistance irrespective of the cold working treatment.

Applicability in Industry

The austenitic stainless steel of the present invention is resistant to neutron-irradiation-induced deterioration and has excellent stress corrosion cracking resistance. Specifically, even after the stainless steel of the present invention is exposed to neutron irradiation of about $1\times10^{22}$ n/cm$^2$ (E>1 MeV), a maximum dose to which a light water reactor can be exposed in its useful plant life, stress corrosion cracking (SCC) was not observed when tested in water under the conditions of a light water reactor. Accordingly, the austenitic stainless steel of the present invention is useful as the core material of a light water reactor, making it possible to carry on operations without a possibility of IASCC until the end of the scheduled plant life of the reactor, thereby improving the reliability of the reactor.

In other words, the austenitic stainless steel of the present invention is highly resistent to neutron-irradiation-induced deterioration, has excellent stress corrosion cracking resistance in water at a high temperature of 270° C. to 350° C. and a high pressure of 70 to 160 atm and has an average thermal expansion coefficient, from room temperature to 400° C., within a range of from $15\times10^{-6}$ to $19\times10^{-6}$/K even after exposure to neutron irradiation of up to $1\times10^{22}$ n/cm$^2$ (E>1 MeV).

In addition, the austenitic stainless steel according to the present invention can be produced using as a base alloy conventionally employed SUS 304 or SUS 316 so that the same materials as used in the conventional production method can be employed. The stainless steel of the present invention has a further advantage in that even after thermal treatment to improve its resistance to neutron-irradiation-induced deterioration, stress resulting from a difference in thermal expansion coefficients between structural components does not occur because the austenitic stainless steel of the present invention has a similar thermal expansion coefficient to that of SUS 304 or SUS 316 used in practice in a reactor.

What is claimed is:

1. An austenitic stainless steel having resistance to neutron-irradiation-induced deterioration obtained by subjecting a stainless steel consisting essentially of not more than 0.08% by weight of C, not more than 2.0% by weight of Mn, not more than 1.5% by weight of Si, not more than 0.045% by weight of P, not more than 0.030% by weight of S, 8.0 to 22.0% of by weight Ni, 16.0 to 26.0% of by weight Cr with the balance as Fe; and having $M_{23}C_6$ in the grain boundary, wherein M is mainly Cr, matching that of the matrix phase produced by subjecting the austenitic steel to thermal solid solution treatment at a temperature of 1,000 to 1,180° C., then to cold working treatment for up to 30% of the cross sectional area, and then to aging treatment at 600 to 750° C. to precipitate $M_{23}C_6$ in the grain boundary matching that of the matrix phase.

2. An austenitic stainless steel having resistance to neutron-irradiation-induced deterioration according to claim 1 further consisting of 3.0% by weight or less of Mo.

3. An austenitic stainless steel having resistance to neutron-irradiation-induced deterioration according to claim 1 wherein said stainless steel is SUS 304 specified in JIS and the temperature for thermal solid solution treatment is at 1,000 to 1,150° C.

4. An austenitic stainless steel having resistance to neutron-irradiation-induced deterioration according to claim 2 wherein said stainless steel is SUS 316 specified in JIS and the temperature for thermal solid solution treatment is at 1,000 to 1,150° C.

5. An austenitic stainless steel having resistance to neutron-irradiation-induced deterioration according to claim 1 wherein said stainless steel is SUS 310S specified in JIS and the temperature for thermal solid solution treatment at 1,030 to 1,180° C.

6. A process to produce an austenitic steel having resistance to neutron-irradiation-induced deterioration obtained by subjecting a stainless steel consisting essentially of not more than 0.08% by weight of C, not more than 2.0% by weight of Mn, not more than 1.5% by weight of Si, not more than 0.045% by weight of P, not more than 0.030% by weight of S, 8.0 to 22.0% of by weight Ni, 16.0 to 26.0% of by weight Cr with the balance as Fe; by subjecting the austenitic steel to thermal solid solution treatment at a temperature of 1,000 to 1180° C., then to cold working treatment for up to 30% of the cross sectional area, and then to aging treatment at 600 to 750° C. to precipitate $M_{23}C_6$, wherein M is mainly Cr, in the grain boundary matching that of the matrix phase.

7. A process according to claim 6 wherein said stainless steel further consists of 3.0% by weight or less of Mo.

8. A process according to claim 6 wherein said stainless steel is SUS 304 specified in JIS and the temperature for thermal solid solution treatment is at 1,000 to 1,150° C.

9. A process according to claim 7 wherein said stainless steel is SUS 316 specified in JIS and the temperature for thermal solid solution treatment is at 1,000 to 1,150° C.

10. A process according to claim 6 wherein said stainless steel is SUS 310S specified in JIS and the temperature for thermal solid solution treatment at 1,030 to 1,180° C.

* * * * *